United States Patent [19]

May

[11] 4,021,143

[45] May 3, 1977

[54] MARINE PROPELLER ARRANGEMENT

[75] Inventor: Eric Raymond May, Kent, England

[73] Assignee: Stone Manganese Marine Limited, London, England

[22] Filed: June 17, 1975

[21] Appl. No.: 587,567

[52] U.S. Cl. ..... 416/174; 416/146 A; 416/244 B

[51] Int. Cl.[2] ..... B63H 1/20

[58] Field of Search ..... 416/146, 146 A, 174, 416/244, 244 B

[56] References Cited

UNITED STATES PATENTS

| | | | |
|---|---|---|---|
| 1,035,404 | 8/1912 | Arnold | 416/244 B X |
| 2,272,128 | 2/1942 | Osborne | 416/90 A |
| 2,987,123 | 6/1961 | Liaaen | 416/157 |
| 3,051,249 | 8/1962 | Dirlik | 416/157 X |
| 3,087,553 | 4/1963 | Kostyun | 416/129 X |
| 3,405,765 | 10/1968 | Herbert | 416/244 B |
| 3,413,008 | 11/1968 | Greiner | 277/58 |
| 3,422,905 | 1/1969 | Muller | 416/174 X |
| 3,469,556 | 9/1969 | Campbell et al. | 416/174 X |
| 3,625,523 | 12/1971 | Gardner et al. | 416/174 X |

FOREIGN PATENTS OR APPLICATIONS

| | | | |
|---|---|---|---|
| 943,349 | 12/1963 | United Kingdom | 416/244 B |

*Primary Examiner*—Everette A. Powell, Jr.
*Attorney, Agent, or Firm*—Pollock, Vande Sande & Priddy

[57] ABSTRACT

The invention concerns a marine propeller support arrangement, in which the center of gravity of the propeller is substantially coincident with the geometrical center of the aftermost stern-tube bearing, which bearing substantially supports the weight of the propeller. The propeller may be driven from its after end by means of a drive plate detachably secured to both the propeller and the propeller shaft. The bearing may be furnished with oil pockets and supplied with pressurized oil. An auxiliary emergency bearing may be provided in the propeller bore.

1 Claim, 1 Drawing Figure

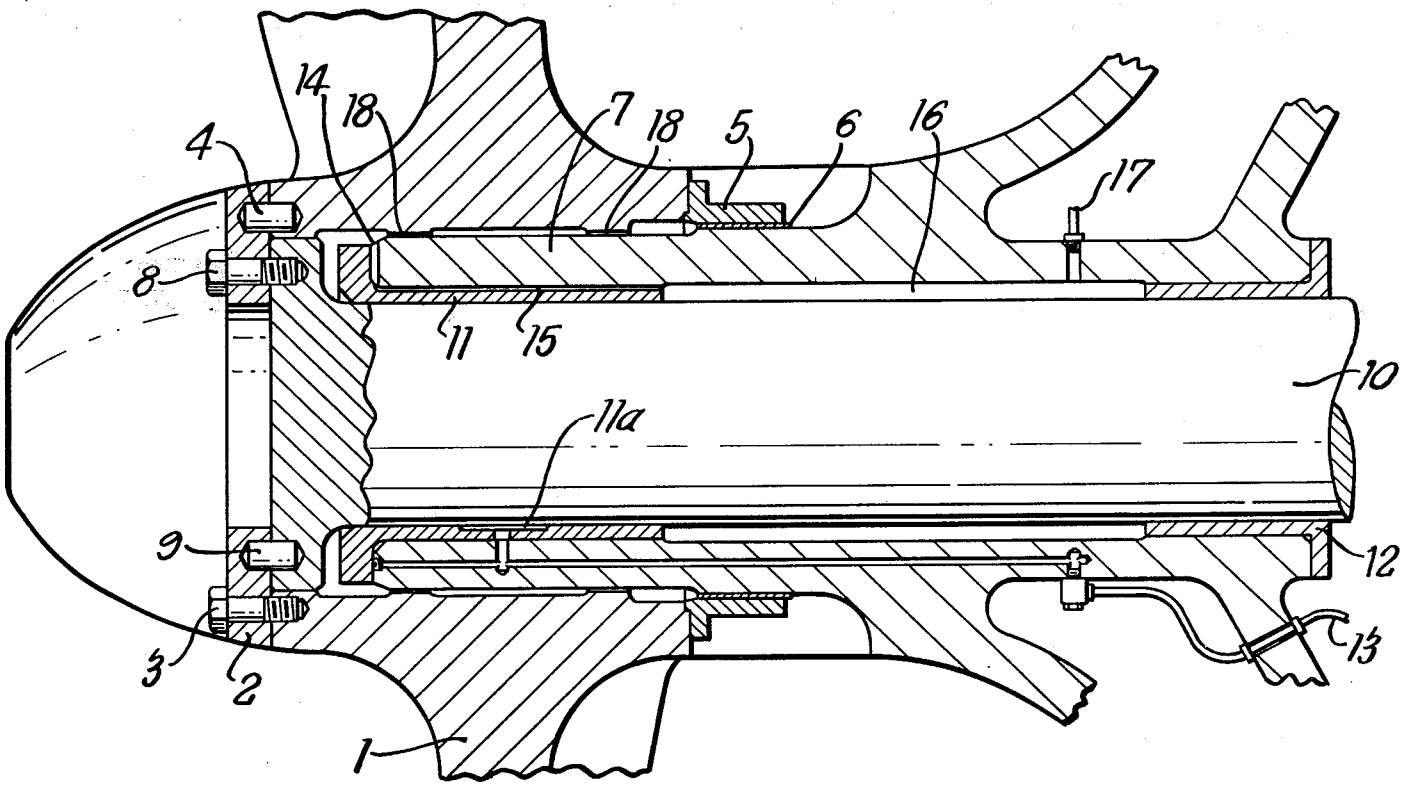
10
12
13
17
16
6
5
18
7
15
11
11a
18
14
4
8
9
3
2
1

MARINE PROPELLER ARRANGEMENT

This invention relates to a marine-propeller support or stern-gear arrangement.

Current tendencies are for large single-screw ships to have larger and heavier propellers than used to be the practice and for these propellers to be operated at lower sppeds of rotation. The propellers concerned may weigh 50–75 tons.

As the size of propellers increases, the area required for their support necessitates a geometrically disproportionate increase in the area of the bearings taking the weight of the propeller, if higher specific pressures are to be avoided.

In a conventional stern-gear arrangement, the propeller is mounted on the shaft so that there is a considerable overhang, i.e., there is a large distance between the propeller and the centre of the aftermost stern-tube bearing shaft. The shaft therefore experiences considerable bending stresses due to the overhanging propeller weight, quite apart from stresses caused by eccentric thrust and thrust variations. During rotation of the shaft, the shaft material experiences bending fatigue due to a combination of the loadings. Increased scantlings of the shaft are necessary to meet the combined stresses. Moreover, deflection of the shaft is caused within the length of the said aftermost bearing. With large propellers, this deflection tends to be large in relation to the thickness of the lubricant film in the bearing.

Furthermore, as the size of propellers increases, it becomes less convenient to remove the propeller when the propeller shaft is required to be examined.

Accordingly, the present invention seeks both to minimise deflection of the propeller shaft over the length of the aftermost stern-tube bearing and to make it possible either to remove the propeller without disturbing the shaft or to remove the shaft without removing the propeller.

In a marine-propeller support arrangement according to the invention, the centre of gravity of the propeller is substantially coincident with the geometrical centre of the aftermost stern-tube bearing, whereby the said bearing substantially supports the weight of the propeller. Thus the invention facilitates alignment by largely obviating tailshaft deflection. A stern tube may therefore be bored to line of sight and the load will be evenly distributed over a bearing coaxial with the line of sight. Since alternating bending loads are minimised, shaft scantlings can be reconsidered with the Classification Society concerned and, since oil film thickness should not vary substantially over the length of the aftermost bearing, barrelling effects will be avoided and increases in specific loading may be considered with confidence. The aftermost stern-tube bearing may be furnished with pockets and be supplied with pressurised fluid, suitably oil, so that the propeller can be supported on a fluid cushion prior to commencement of rotation and during slow-speed rotation.

Advantageously the propeller is driven from its after end, suitably by means of a drive plate secured to both the propeller and the tailshaft.

The support arrangement or stern gear may comprise a stern frame with an axial opening therethrough, a propeller shaft and a propeller connected thereto either by means of a driving plate or directly, and a tubular member which extends through or bounds the opening in the stern frame and which contains the stern-tube bearings. The tubular member may either be connected removably to the stern frame or form part of the structure of the stern frame. An oil supply may be provided to the aftermost bearing at a pressure and over an area such that the weight of the propeller can be wholly supported by oil prior to commencement of rotation with a view to reduction of bearing wear.

A preferred embodiment of the invention by way of example is shown in a vertical longitudinal section in the accompanying drawing.

A propeller 1 is driven from a tailshaft 10 through a drive plate 2. The plate 2 is detachably secured to the propeller by a ring of bolts, of which one is shown at 3, and a number of dowels, of which one is shown at 4. Ingress of water into the bore of the propeller is prevented by a gland 5 of known design working on a wear ring 6 or non-ferrous sleeve shrunk on to a stern tube 7. The plate 2 is detachably secured to the shaft 10 by a ring of bolts, of which one is shown at 8, and a number of dowels, of which one is shown at 9. The tailshaft 10 is borne in conventionally supported stern-tube bearings 11 and 12.

As will be apparent, the propeller 1 is so disposed that its center of gravity is substantially coincident with the geometrical center of the aftermost stern-tube bearing 11.

Oil-supply means 13 provide the bearing 11, which may have pockets **11*a*, with oil at a sufficiently high pressure to lift the shaft 10 prior to commencement of rotation and during slow-speed rotation, for example during manoeuvring at low speeds and when turning engines. Oil holes 14 and passages 15 return oil which leaks from the after end of the bearing 11 back to the annular space 16 between the bearings 11 and 12 and through a connection 17 back to a stern-tube oil-pressurising tank (not shown) fitted above the waterline, so that the stern-tube pressure exceeds the sea-water pressure by an amount acceptable for satisfactory operation of the gland 5.**

Auxiliary, inwardly projectng bearing surfaces 18 are provided in the propeller bore to support the propeller on the exterior of the stern tube during shaft removal and also to limit the effects of failure of the bearing 11 in service. As shown in the FIGURE, surfaces 18 have sufficient clearance with the outer diameter of stern tube 7 to avoid contact except during shaft removal and emergency conditions.

The above-described arrangement permits the propeller to be removed without removal of the tailshaft. It also permits withdrawal of the tailshaft without removal of the propeller.

I claim:

1. Support apparatus for a marine propeller having a propeller hub with a bore, comprising:

a propeller shaft having said propeller hub mounted on the aft end thereof;

a drive plate detachably secured to the aft ends of both said propeller and said propeller shaft;

a stern tube surrounding said propeller shaft and extending aft into said bore of said propeller hub, said stern tube having an outer diameter, said outer diameter being sufficiently smaller than said bore of said propeller hub to avoid contact of said tube with said bore in service;

at least an aft shaft bearing mounted inside said stern tube, said aft bearing being located with its geometrical center substantially coincident with the center of gravity of said propeller, said aft shaft bearing having oil pockets with pressurized fluid whereby said propeller can be supported on a fluid cushion prior to commencement of rotation and during low speed rotation; and at least one inwardly projecting auxiliary bearing surface in said bore of said propeller on which the weight of said propeller can be supported on said outer diameter of said stern tube when said apparatus is not in service, whereby said propeller shaft may be withdrawn; and by which movement of said propeller will be limited in the event of failure of said aft bearing in service, whereby said propeller runs on said aft shaft bearing in service without contacting said stern tube and the weight of said propeller is supported in service solely by said aft bearing acting between said propeller shaft and said stern tube.

* * * * *